US006685459B2

(12) United States Patent
Hess et al.

(10) Patent No.: US 6,685,459 B2
(45) Date of Patent: Feb. 3, 2004

(54) APPARATUS FOR TREATING BLOCKS

(75) Inventors: Walter Hess, Burbach (DE); Thomas Juli, Ancaster (CA)

(73) Assignee: Hess Maschinenfabrik GmbH & Co. KG, Burbach-Wahlbach (DE)

( * ) Notice: Subject to any disclaimer, the term of this patent is extended or adjusted under 35 U.S.C. 154(b) by 118 days.

(21) Appl. No.: 10/068,354

(22) Filed: Feb. 6, 2002

(65) Prior Publication Data

US 2003/0138516 A1 Jul. 24, 2003

(51) Int. Cl.[7] ..... B28B 11/08
(52) U.S. Cl. ..... 425/343; 425/385
(58) Field of Search ..... 425/343, 385, 425/402, 403.1, 472; 264/293

(56) References Cited

U.S. PATENT DOCUMENTS 2,146,957 A * 2/1939 Jones ..... 425/385
4,568,260 A * 2/1986 Paul et al. ..... 425/385
6,109,906 A * 8/2000 Castonguay et al. ..... 425/385
6,540,501 B1 * 4/2003 Bott ..... 425/385
6,575,727 B2 * 6/2003 Ciccarello et al. ..... 425/385

FOREIGN PATENT DOCUMENTS

DE 4142396 * 6/1993
WO WO97/24210 * 7/1997

* cited by examiner

*Primary Examiner*—James P. Mackey
(74) *Attorney, Agent, or Firm*—Alix, Yale & Ristas, LLP

(57) ABSTRACT

The invention relates to an apparatus for treating blocks, having a conveying arrangement for transporting the blocks one after the other along a treatment station in which there is arranged at least one tool holder which can be driven in circulation by means of a drive, has a longitudinal axis and on which there are fastened flexible, elongate treatment tools which have two ends and come into contact with predetermined regions of the blocks as the tool holder circulates. The flexible treatment tools are fastened in loop form, by way of the two ends, on the tool holder such that they are spaced apart from one another in the direction of the longitudinal axis of the latter, with the result that they sag when the tool holder is at a standstill.

14 Claims, 4 Drawing Sheets

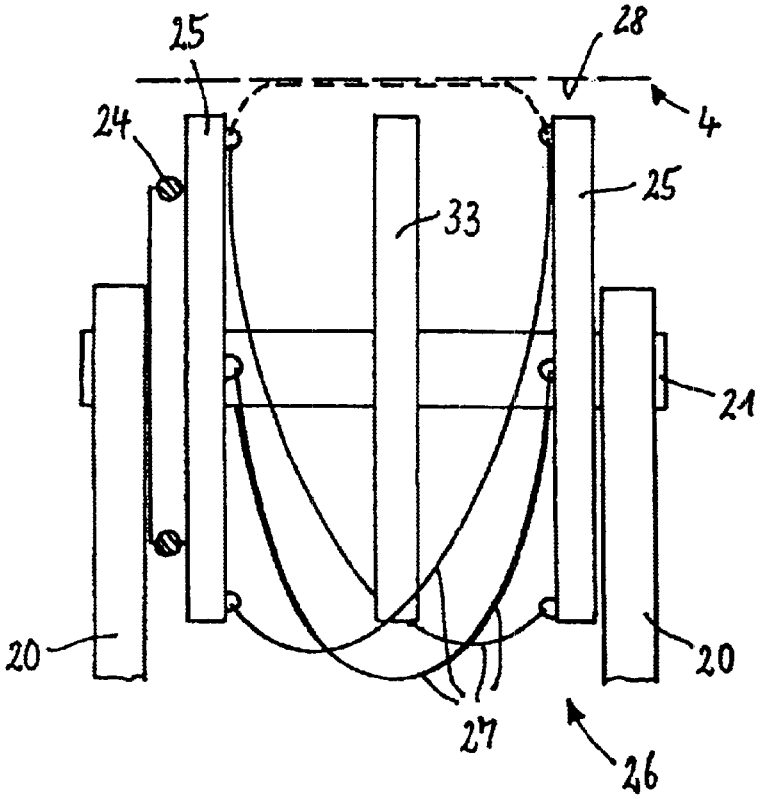
Fig. 3
Fig. 4
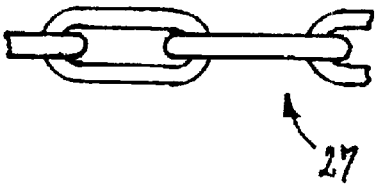
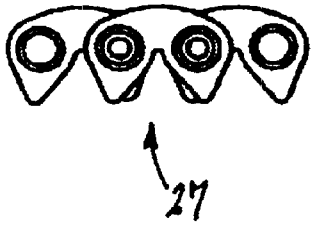
Fig. 5
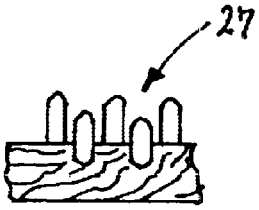
Fig. 6

APPARATUS FOR TREATING BLOCKS

FIELD OF THE INVENTION

The invention relates to an apparatus for treating blocks like masonry blocks out of natural or artificial material like concrete.

Walls, in particular for landscape architecture, are preferably produced from natural or manmade blocks which are provided, on the visible side, with a surface structure of irregular relief and/or broken edges, as produced, for example, by the manual working of natural blocks. Concrete blocks can only be produced with essentially planar surfaces. It is also the case, however, that split natural blocks generally have sharp edges.

DESCRIPTION OF THE RELATED ART

U.S. Pat. No. 6,109,906 discloses an apparatus for the surface treatment of masonry blocks, the blocks, once formed and hardened, being conveyed along a treatment station to the right and left by means of two conveying arrangements such that they project somewhat in the direction of the treatment station in relation to the respective conveying arrangement. For this purpose, the blocks are transported in a manner in which they are clamped in between the bottom strand and the top strand of two conveyors of the respective conveying arrangement. Located in the treatment station are one or more vertically arranged drums which are equipped, on the circumference, with chains which, at their free ends, bear striking heads which, upon rotation of the drums, alternately come into contact with the surfaces of the blocks guided along to the right and left thereof. As a result, although the visible surface of the blocks is subject to impact treatment, in which case the edges are also broken, it is only the striking heads which take effect here in each case, it being the case, in addition, that said striking heads bounce back onto the block following the impact and have to be moved back into the striking position again by correspondingly high centrifugal force as a result of rapid rotation of the tool holder. This means that the operation of treating the blocks is not very effective, quite apart from the fact that a relatively large quantity of waste is also produced as a result of the impact treatment.

SUMMARY OF THE INVENTION

An object of the invention is thus to provide an apparatus for the treatment of blocks which provides a more effective and careful treatment.

A further object of the invention is to provide an apparatus for the treatment of blocks which may be used for a treating a surface of the blocks which treating is variable in a desired manner.

A further object of the invention is to provide an apparatus for the treatment of blocks with an enhanced speed.

According to the invention an apparatus for treating blocks is provided, comprising:

a treatment station with at least one rotatable tool holder;

a conveying device for transporting the blocks one after the other along the treatment station;

the at least one rotatable tool holder having a longitudinal axis and flexible, elongate treatment tools having two ends mounted thereon, wherein the flexible treatment tools come into contact with predetermined regions of the blocks as the tool holder rotates; and the tools are fastened in loop form, by way of the two ends, on the tool holder such that they are spaced apart from one another in the direction of the longitudinal axis of the latter, with the result that they sag when the tool holder is at a standstill.

Since use is made of loop-form treatment tools which are fastened on the tool holder, by way of the two ends, such that they are spaced apart from one another in the direction of the longitudinal axis of the latter, with the result that they sag when the tool holder is at a standstill and spread out in arcuate form in the outward direction on account of the centrifugal force as the tool holder rotates, the flexible treatment tools conform to the blocks as they strike them and treat the blocks over a corresponding length and, moreover, essentially with abrading and/or grating action, with the result that the treatment is careful, on the one hand, and very effective, on the other hand.

The action can be enhanced or reduced by adjusting the distance between the tool holder and block surface as well as by the rotational speed, depending on the degree of roughness desired for the configuration. The action may be also varied by variation of the transportation speed of the blocks along the treatment tools.

Further objects, advantages and embodiments of the invention are evident from the following description.

BRIEF DESCRIPTION OF THE DRAWINGS

FIG. 3 shows, schematically, a set of tools for the apparatus from FIG. 1.

FIGS. 4 to 6 show, in detail form, different embodiments of treatment tools.

DETAILED DESCRIPTION OF THE INVENTION AND THE PREFERRED EMBODIMENT

The invention is explained in more detail hereinbelow with reference to an exemplary embodiment illustrated in the attached Figures.

Figure 1:
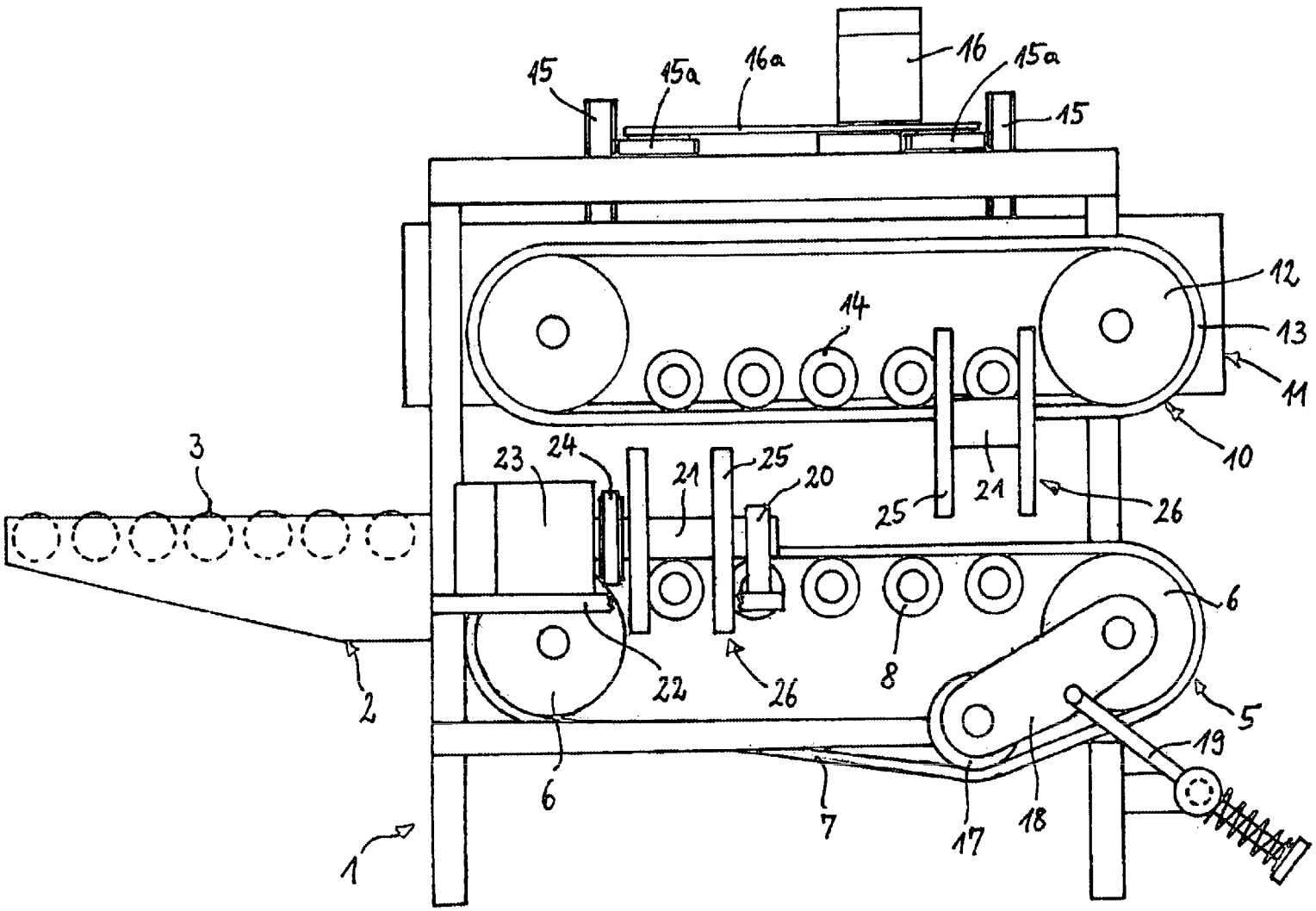
FIG. 1 shows a schematic side view of an apparatus for treating blocks.
Figure 2:
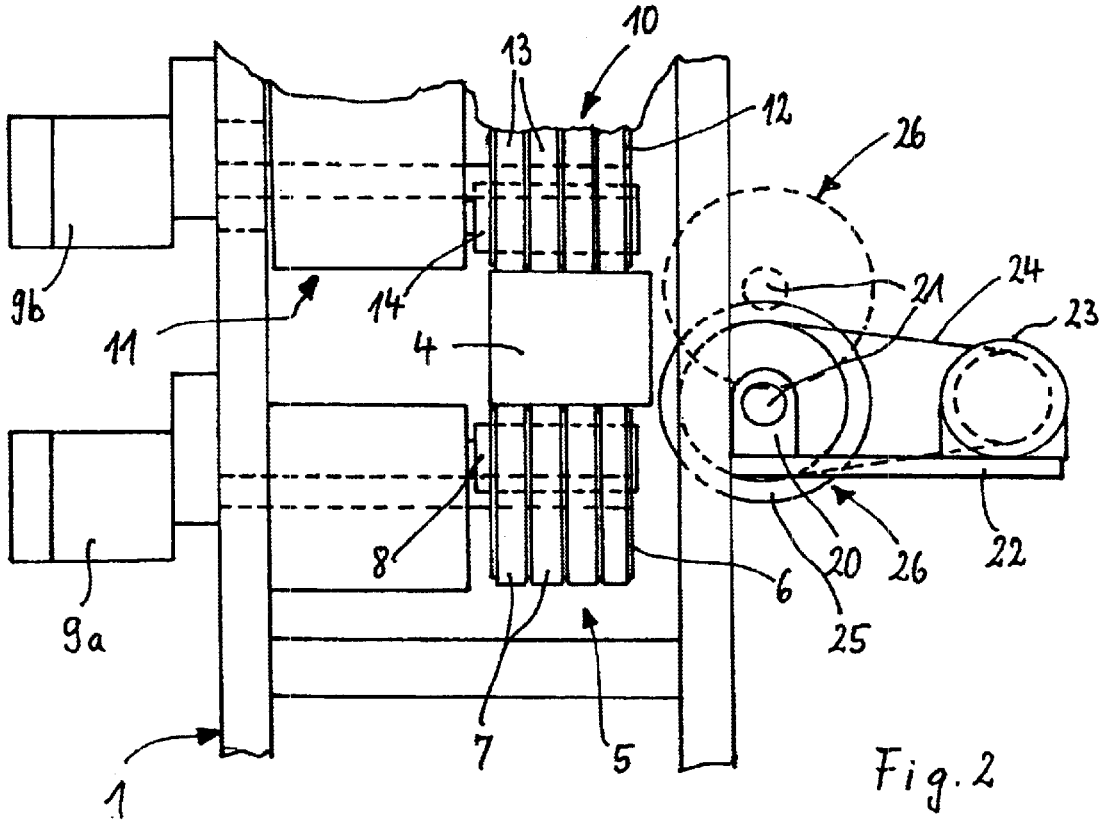
FIG. 2 shows a schematic front view of part of the apparatus from FIG. 1.

The apparatus illustrated in FIGS. 1 and 2 comprises a framework 1 on which there is fitted, on the inlet side, a roller conveyor 2 with possibly driven rollers 3 for feeding natural or manmade blocks 4, for example concrete blocks, said roller conveyor terminating at the top strand of a bottom conveyor 5. The bottom conveyor 5 comprises two deflecting rollers 6 which are mounted in the framework 1 and about which a plurality of V-belts 7 arranged one beside the other are guided. The V-belts 7, in particular toothed belts, are supported in the top strand of the conveyor 5 by supporting rollers 8. Driving takes place via an electric motor 9*a* which is fastened on the framework 1 and of which the output shaft drives one of the deflection rollers 6.

A further conveyor 10 is provided above the conveyor 5, at a distance therefrom. The conveyor 10 is accommodated by a frame 11 which is guided in a vertically adjustable manner in the framework 1, in particular by means of an electric motor 16. The conveyor 10 likewise has two deflecting rollers 12, about which a plurality of V-belts 13 arranged one beside the other are guided. The V-belts 13, in particular toothed belts, are supported in the upward direction in the bottom strand by supporting rollers 14. Driving takes place via the electric motor 9*b* which is fastened on the frame 11 and of which the output shaft drives one of the deflecting rollers 12.

The frame 11 here may be provided, for example, with spindles 15 which can be rotated in relation to the frame 11, are accommodated rotatably in the top side of the framework 1 and can be rotated together via a V-belt 16*a*, actuated by the electric motor 16, and in each case one pinion 15*a*, which engages with the respective spindle 15 and is rotated via the V-belt 16*a*, in order thus to move the frame 11 up and down in relation to the framework 1. For this purpose, furthermore, the frame 11 may be guided vertically via guides (not illustrated).

The two conveyors 5 and 10 form a conveying arrangement for the blocks 4, said conveyors, once they have received the blocks from the roller conveyor 2, as a result of the supporting rollers 8, 14, which may be provided with elastic coatings, for example made of hard rubber or the like, conveying said blocks with the latter clamped in between them. Since the distance between the two conveyors 5, 10 is vertically adjustable, the apparatus can be used for different sizes of block.

The conveyors 5 and 10 expediently have tensioning arrangements for the V-belts 7 and 13, which may comprise for example—as is illustrated for the bottom conveyor 5—a tensioning roller 17 which is arranged such that it can be rotated, via a rocker 18, about the axis of one of the deflecting rollers 6, it being possible for the rocker 18, for tensioning purposes, to be secured or—as is illustrated—spring-biased in an adjustable manner, for example, in relation to the framework 1 via an articulated rod 19.

The two conveyors 5, 11 may, if appropriate, also be driveable via a common drive for the purpose of straightforward synchronization.

Also provided on the framework 1 are bearing blocks 20 for the purpose of bearing shafts 21 which are arranged horizontally in the transporting direction of the blocks 4 and belong to two sets of tools which are offset vertically and spaced apart from one another in the transporting direction. Each shaft 21 can be driven via an electric motor 23, arranged on a corresponding outwardly projecting bracket 22, and a V-belt 24. It is possible for the bearing blocks 20—as is illustrated—to be arranged on the brackets 22. Located on each shaft 21 are at least two axially spaced-apart disks 25, with the result that a rotatable tool holder 26 is formed (the right-hand tool holder 26 has been illustrated, for the sake of simplicity, without a bearing means or drive in FIG. 1 and has only been indicated by dashed lines in FIG. 2). Each tool holder 26 has flexible treatment tools 27 (not illustrated in FIGS. 1 and 2) fastened on the disks 25. In this case, the flexible treatment tools 27 are fastened in loop form, by way of the two ends, on the tool holder 26 such that they are spaced apart from one another in the direction of the longitudinal axis of the latter, with the result that they sag when the tool holder 26 is at a standstill, see FIG. 3.

When the tool holder 26 is rotated by the electric motor 23, the respective treatment tool 27, once it has passed the respective block edge, forms an outwardly directed loop, indicated by dashes in FIG. 3, on account of the centrifugal force acting thereon, said loop being adapted to the block surface 28, on account of the flexibility of the treatment tool 27, as it strikes the block 4 and treating said block surface over a corresponding length.

The respective sets of treatment tools 27 of the two tool holders 26 treat the top and the bottom edges of the respective block 4 and part of the visible side of the block 4 adjacent thereto, the block surface 28, in order to roughen the same. This operation is at its most effective if the treatment tools 27 strike the top edge from above and the bottom edge from beneath. For this purpose, the tool holders 26 can be driven correspondingly in opposite directions.

The treatment tools 27 expediently have their two ends fastened on the tool holder 26 in an offset manner in the circumferential direction of said tool holder. In the exemplary embodiment illustrated in FIG. 3, this offset is 180°. It may also be smaller, however, and is preferably located in the range of from 40° to 180°, in particular in the range of from 90° to 180°.

It goes without saying that, instead of the four treatment tools 27 provided on a tool holder 26 according to FIG. 3, it is also possible for more than four, or fewer than four, tools to be provided, although it should nevertheless generally be ensured that they are distributed uniformly over the circumference of the tool holder 26, in order to avoid unbalances.

The rotational speed of the electric motors 23 may be adjustable in order, depending on customer requirements, to enhance or to reduce the treatment-inducible effect of breaking the edges and roughening the visible surface.

It is possible for the bearing blocks 20 to be adjustable and securable, on the bracket 22, on a guide (not illustrated) in the horizontal direction, transversely to the transporting direction of the blocks 4, in order thus for the distance between the block surface 28 and tool holder 26 to be adjusted. This also makes it possible, depending on customer requirements, to enhance or reduce the treatment-inducible effect of breaking the edges and roughening the visible surface.

It is also possible for the top tool holder 26 (on the right in FIG. 1), which acts on the top edge of the block 4, to be connected, via its corresponding bracket, to the frame 11, rather than to the framework 1, in order for it to be possible for said tool holder to be vertically adjusted by way of said frame.

Figure 7:
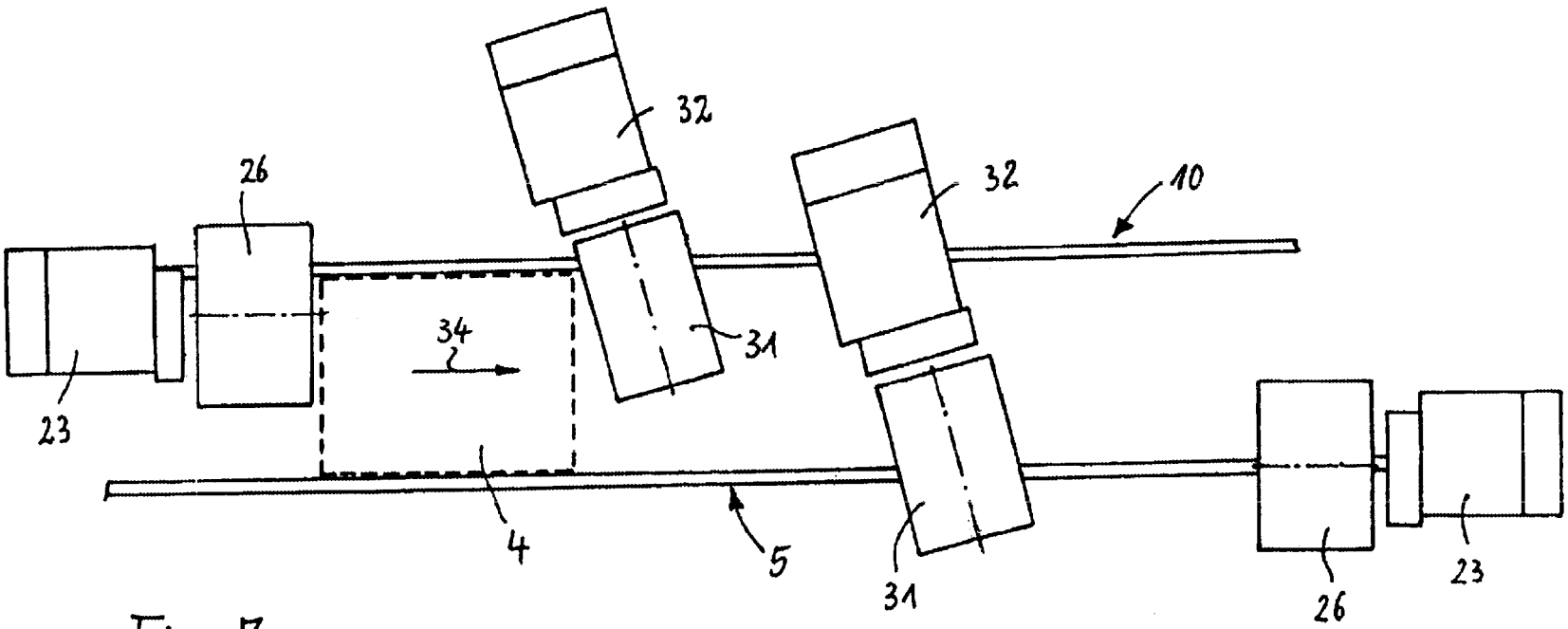
FIG. 7 shows, schematically, an arrangement for treating an entire visible surface of a block.

In order for the leading and trailing edges of the visible surface or the block surface 28 and the visible surface to be treated in addition, it is possible for two additional tool holders 31 with associated electric motors 32 to be fastened, possibly in the vertically offset state in relation to one another, on the framework 1 in a manner corresponding to the tool holders 26, as is illustrated schematically in FIG. 7, although in this case the axes of the tool holders 31, rather than running horizontally, run vertically or preferably obliquely in relation to the vertical, in particular at an angle of approximately 10° to 30°, in a vertical plane parallel to the conveying direction of the blocks 4. In respect of the tool holders 31, it is also expedient if these are driven in opposite directions of rotation, with the result that the treatment tools 27 come into contact with the leading and trailing side edges of the respective block 4 from the outside in each case. The longitudinal axes of the tool holders 31 here are preferably arranged parallel to one another, but may also be angled in relation to one another.

If the treatment tools 27 do not pass over the entire visible surface of the blocks 4, the respective pairs of tool holders 26, 31 are expediently arranged such that the treatment regions overlap.

As is illustrated in FIG. 3, the tool holder 26 (or 31) may have one or more intermediate disks 33 in order in this way to form a kind of drum, as a result of which the flexible treatment tools 27 do not sag inward to any significant extent and cannot interfere with one another. Instead of this, it is also possible for a drum to be used as the tool holder 26, 31.

The treatment tools 27 may be chains, for instance link chains, and so for example round link chains (FIG. 4) or plate link chains or flat link articulated chains, of which the individual links are connected to one another in an articulated manner by bolts, or toothed chains (FIG. 5), of which the links have teeth.

It is also possible, however, for the treatment tools 27 to be wire cables which are equipped, in particular, with outwardly projecting, for example nail-like metal parts (FIG. 6).

Before the blocks 4, in particular concrete blocks, which are to be processed are fed to the apparatus for treatment purposes (transportation direction according to arrow 34 in FIG. 7), it is possible for untreated blocks originating from the block production to be fed in layers to a splitting arrangement in which preferably the untreated blocks are split in half into blocks 4 which then, split up into two product streams in accordance with the splitting operation which has taken place, are conveyed onto two spaced-apart transporting lines with the surfaces produced by the splitting operation being directed toward one another. Arranged on the mutually facing inner sides of the two transporting lines in each case are one or more apparatuses for treating the splitting-induced surfaces as visible surfaces of the blocks 4. At the end of the transporting lines, the treated blocks 4 of the two transporting lines may then be brought together and stacked in a transportable manner. The apparatuses for treatment purposes are located in the interior between the transporting lines and are expediently additionally provided with dust-protection covers in order for the escape of dust produced during treatment to be largely avoided.

Although the foregoing has been a description of preferred embodiments of the invention, it will be apparent to those skilled in the art that numerous variations and modifications may be made in the invention without departing from the scope as described herein.

What is claimed is:

1. An apparatus for treating blocks, comprising:

a treatment station with at least one rotatable tool holder;

a conveying device for transporting the blocks one after the other along the treatment station;

said at least one rotatable tool holder having a longitudinal axis and supporting at least one flexible, elongate treatment tool having two ends;

wherein each treatment tool is attached to the tool holder at said two ends, with the attachments spaced apart in the direction of said longitudinal axis, thereby forming a loop such that the tools come into contact with predetermined regions of the conveyed blocks as the tool holder rotates, and the tools sag when the tool holder is at a standstill.

2. The apparatus as claimed in claim 1, wherein the treatment tools comprise individual links which are connected to one another in a flexible manner.

3. The apparatus as claimed in claim 2, wherein the treatment tools are chains.

4. The apparatus as claimed in claim 1, wherein the treatment tools are wire cables.

5. The apparatus as claimed in claim 4, wherein the wire cables are equipped with outwardly projecting metal parts.

6. The apparatus as claimed in claim 1, wherein the treatment tools have their two ends fastened on the tool holder in an offset manner in the circumferential direction of said tool holder.

7. The apparatus as claimed in claim 1, including a rotational drive for the tool holder, having an adjustable speed of rotation.

8. The apparatus as claimed in claim 1, wherein said at least one tool holder is supported in the treatment station at a distance from the block surface to be treated, and said distance is adjustable.

9. The apparatus as claimed in claim 8, wherein the distance of the at least one tool holder to the block surface to be treated is adjustable by an electric motor.

10. The apparatus as claimed in claim 1, wherein two tool holders are arranged one behind the other, as seen in the conveying direction of the blocks, for treating opposite edges of the blocks, and are driveable in opposite directions.

11. The apparatus as claimed in claim 1, wherein a pair treatment units having treatment tools attached on tool holders, with the longitudinal axes of these tool holders being arranged horizontally, are provided for treating along the top and bottom edges of the visible side of a block.

12. The apparatus as claimed in claim 1, wherein a pair of treatment units having treatment tools attached on tool holders, the longitudinal axes of the tool holders being arranged in a vertical plane parallel to the conveying arrangement, are provided for treating the leading and trailing edges of the blocks, as seen in the transporting direction of said blocks.

13. The apparatus as claimed in claim 11, wherein the longitudinal axes of the tool holders are arranged parallel to one another and obliquely in relation to the vertical.

14. The apparatus as claimed in claim 12, wherein the longitudinal axes of the tool holders are arranged obliquely in relation to the vertical at an angle of approximately 10° to 30°.

* * * * *